US006931720B2

(12) United States Patent
Thompson

(10) Patent No.: US 6,931,720 B2
(45) Date of Patent: Aug. 23, 2005

(54) DUMP TRUCK BED FORMING APPARATUS

(75) Inventor: Paul Thompson, Walnut Grove, CA (US)

(73) Assignee: G-Force, Inc., Carson City, FL (US)

( * ) Notice: Subject to any disclaimer, the term of this patent is extended or adjusted under 35 U.S.C. 154(b) by 20 days.

(21) Appl. No.: 10/431,112

(22) Filed: May 5, 2003

(65) Prior Publication Data

US 2003/0229977 A1 Dec. 18, 2003

Related U.S. Application Data

(60) Provisional application No. 60/378,328, filed on May 6, 2002.

(51) Int. Cl.[7] ..... B23P 19/00; B23Q 3/00

(52) U.S. Cl. ..... 29/801; 29/283.5

(58) Field of Search ..... 29/59, 34 R, 801, 29/283.5, 422, 897, 56.5, 56.6; 72/452.5, 407, 453.03, 450; 100/176

(56) References Cited

FOREIGN PATENT DOCUMENTS

JP 2001030348 * 2/2001

* cited by examiner

*Primary Examiner*—John C. Hong
(74) *Attorney, Agent, or Firm*—Sierra Patent Group, Ltd.

(57) ABSTRACT

The disclosed device is directed toward an apparatus for forming dump beds. The apparatus comprises a support structure having a base configured to support at least one side. A first side is coupled to the base. A second side is coupled to the base. A header is mounted to the first side and the second side. The header is configured to support a forming press. A first roller is coupled to the base. The first roller includes a first adjustable mount and a first press operatively coupled to the first adjustable mount. A second roller is coupled to the base opposite the first roller. The second roller includes a second adjustable mount and a second press operatively coupled to the second adjustable mount. A forming press is mounted in the header. The forming press includes at least one die coupled to the forming press. The forming press is configured to press a material between the first roller and the second roller to form a portion of a dump bed.

7 Claims, 5 Drawing Sheets

DUMP TRUCK BED FORMING APPARATUS

CROSS REFERENCE TO RELATED APPLICATIONS

This application is a United States Non-Provisional Patent Application claiming priority to a U.S. Provisional Patent Application Ser. No. 60/378,328 filed May 6, 2002.

FIELD OF THE INVENTION

The invention disclosed in this document relates to a device for manufacturing. The manufacturing apparatus is used to form beds for dump trucks and trailer boxes for dump trailers.

BACKGROUND

The industry of transporting large volumes of materials relies on employing vehicles of sufficient power and capacity to contain and safely move material over a variety of surfaces. Railroad supported material handling cars in large trains move bulky material such as coal and corn over long distances through fixed transportation routes. Motorized vehicles, like dump trucks, of all sizes haul materials over shorter distances and in more diverse transportation routes. In certain regions, dump trucks keep in tow one or more dump trailers in order to increase the size of the load being hauled per trip. In all the transportation devices utilized, a dump bed is the basic container for the materials. The dump bed, dump box, or simply box is subjected to wear and loads that require a very durable and rugged design. The structure must be very strong and yet minimize weight so that the vehicle equipped with the box can maximize the quantity of material being hauled per trip.

The standard box is comprised of five basic components, a bottom (or bed), which serves as the base of the box to be attached to the vehicle. Three walls (or sides) are vertically mounted to the bed and attached at two common corners. A fourth side remains open to facilitate a gate for unloading the contents of the box. Often, reinforcing members are attached to the outside surfaces to improve structural integrity while minimizing weight.

The standard form of construction for the box is to align a heavy sheet of steel on braces in a horizontal fashion. This sheet of material, typically steel, will be the bed of the box. Subsequently, more braces are erected above and around the bed. Then each side, typically lighter sheets of steel, are rigged to the bracing and meticulously maneuvered into position to be attached by welding processes. All three sides are capable of distortion while being assembled, and therefore must be repeatedly readjusted with heavy-duty presses and rigging equipment. The standard process is very time consuming as well as inconsistent. Each box is constructed individually, and each box is different in final dimension. Additionally, the above-described assembly process requires skilled welders and mechanics, thus adding to the cost of construction.

SUMMARY

The disclosed device is directed toward an apparatus for forming dump beds. The apparatus comprises a support structure having a base configured to support at least one side. A first side is coupled to the base. A second side is coupled to the base. A header is mounted to the first side and the second side. The header is configured to support a forming press. A first roller is coupled to the base. The first roller includes a first adjustable mount and a first press operatively coupled to the first adjustable mount. A second roller is coupled to the base opposite the first roller. The second roller includes a second adjustable mount and a second press operatively coupled to the second adjustable mount. A forming press is mounted in the header. The forming press includes at least one die coupled-to the forming press. The forming press is configured to press a material between the first roller and the second roller to form a portion of a dump bed.

A method of forming a dump bed using a dump bed forming apparatus is disclosed. The method comprises disposing a plate material between a set of opposing rollers and a forming press, wherein the set of opposing rollers are coupled to a base of a structure having the base coupled to a first side and an opposing second side supporting a header. The forming press being mounted to the header. The forming press is positioned to extend between the set of opposing rollers toward the base and away from the header. The method includes adjusting the set of opposing rollers in one of an opposite direction and an attractive direction. The method includes adjusting the forming press in one of an enlarged state and a reduced state. The method includes pressing the plate material with the forming press toward the base into and between the set of opposing rollers to a predetermined distance to form a bed plate. The method includes attaching a dump bed sub frame to the bed plate. The method includes attaching a front end and a tail gate end to the bed plate.

DETAILED DESCRIPTION

A dump box apparatus is described that overcomes the deficiencies of the above mentioned prior art methods and designs.

Figure 1:
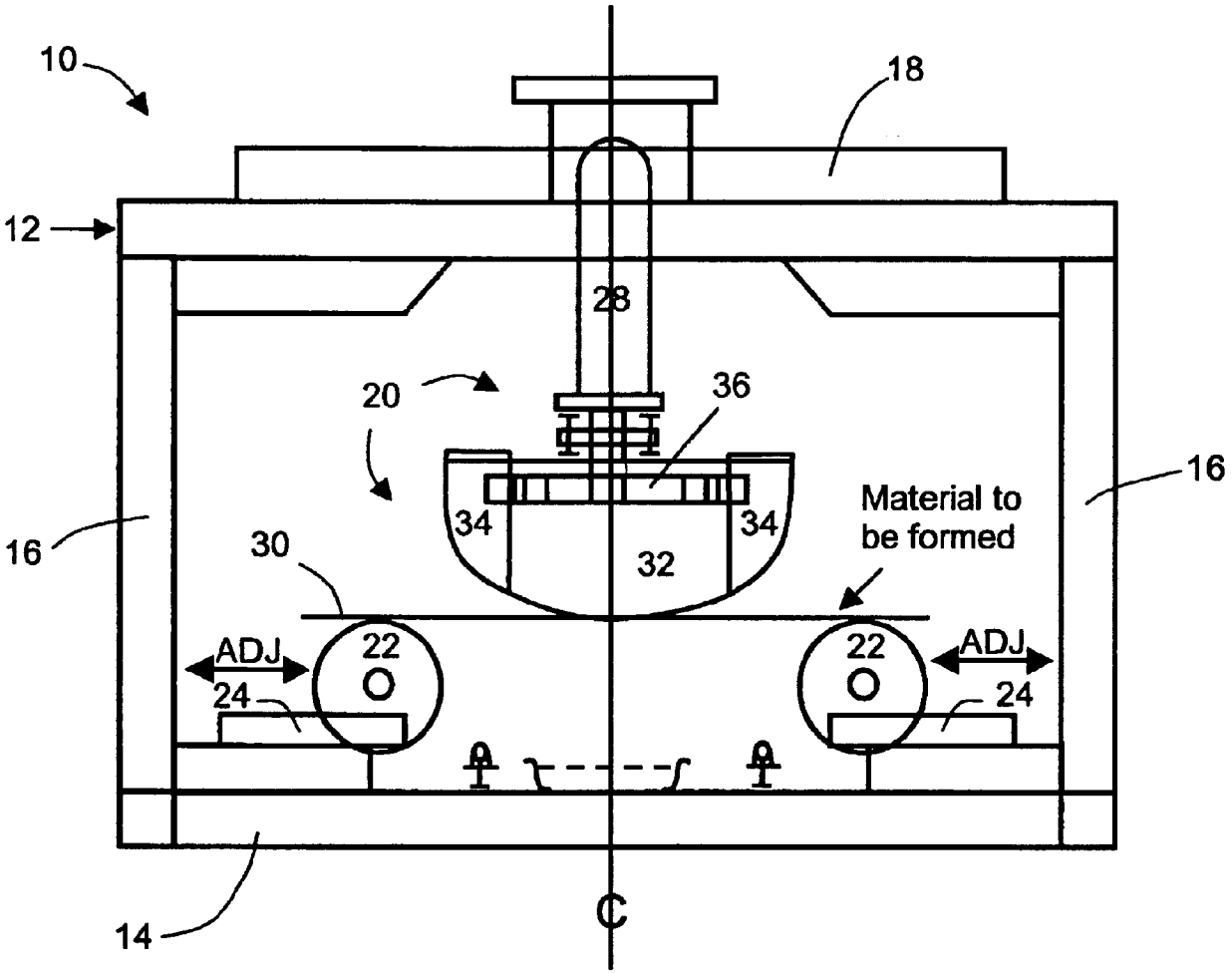
FIG. 1 is a front view of an exemplary bed forming apparatus prior to forming a portion of the truck bed.
Figure 2:
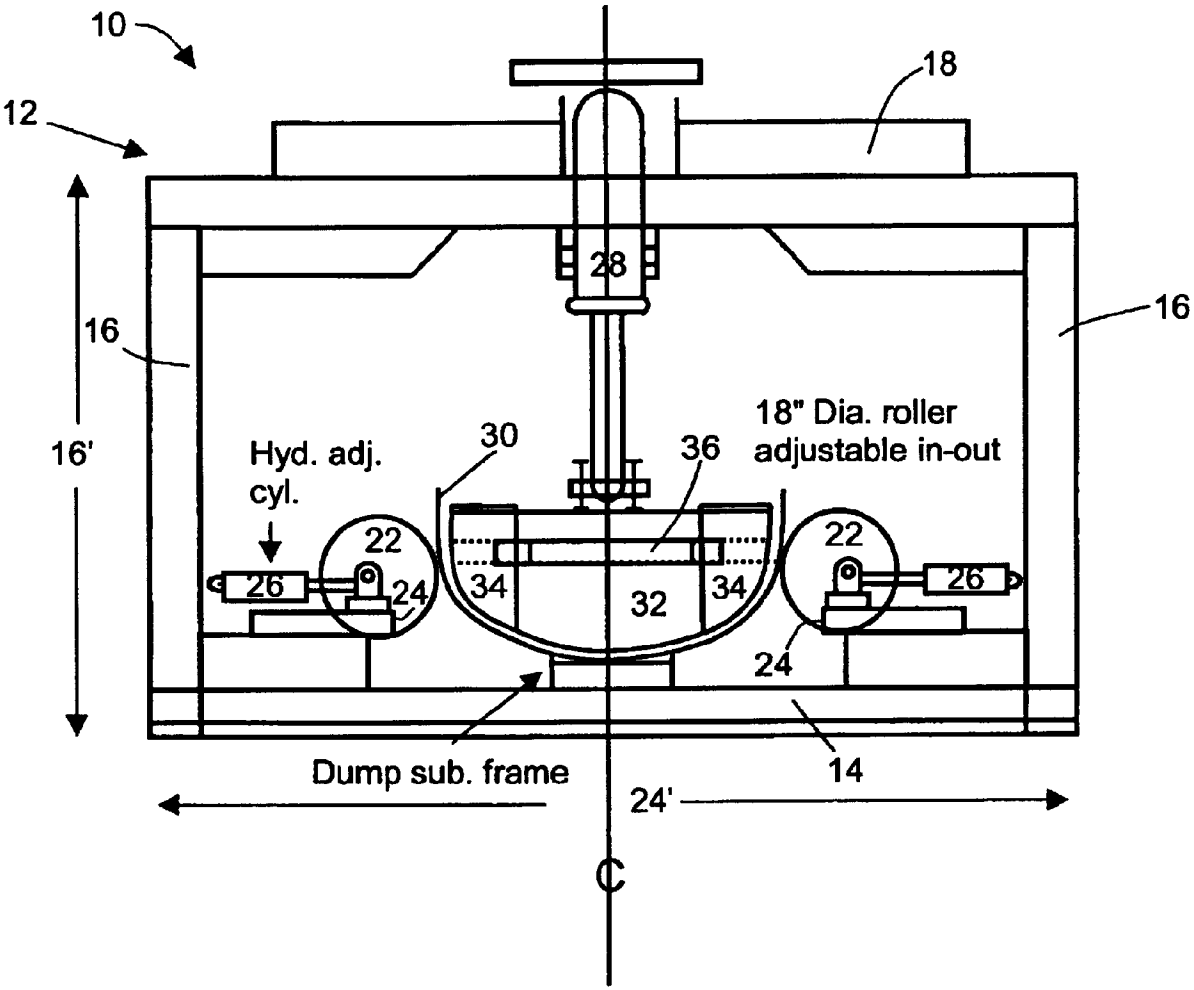
FIG. 2 is a front view of an exemplary bed forming apparatus after pressing a portion of the truck bed.
Figure 3:
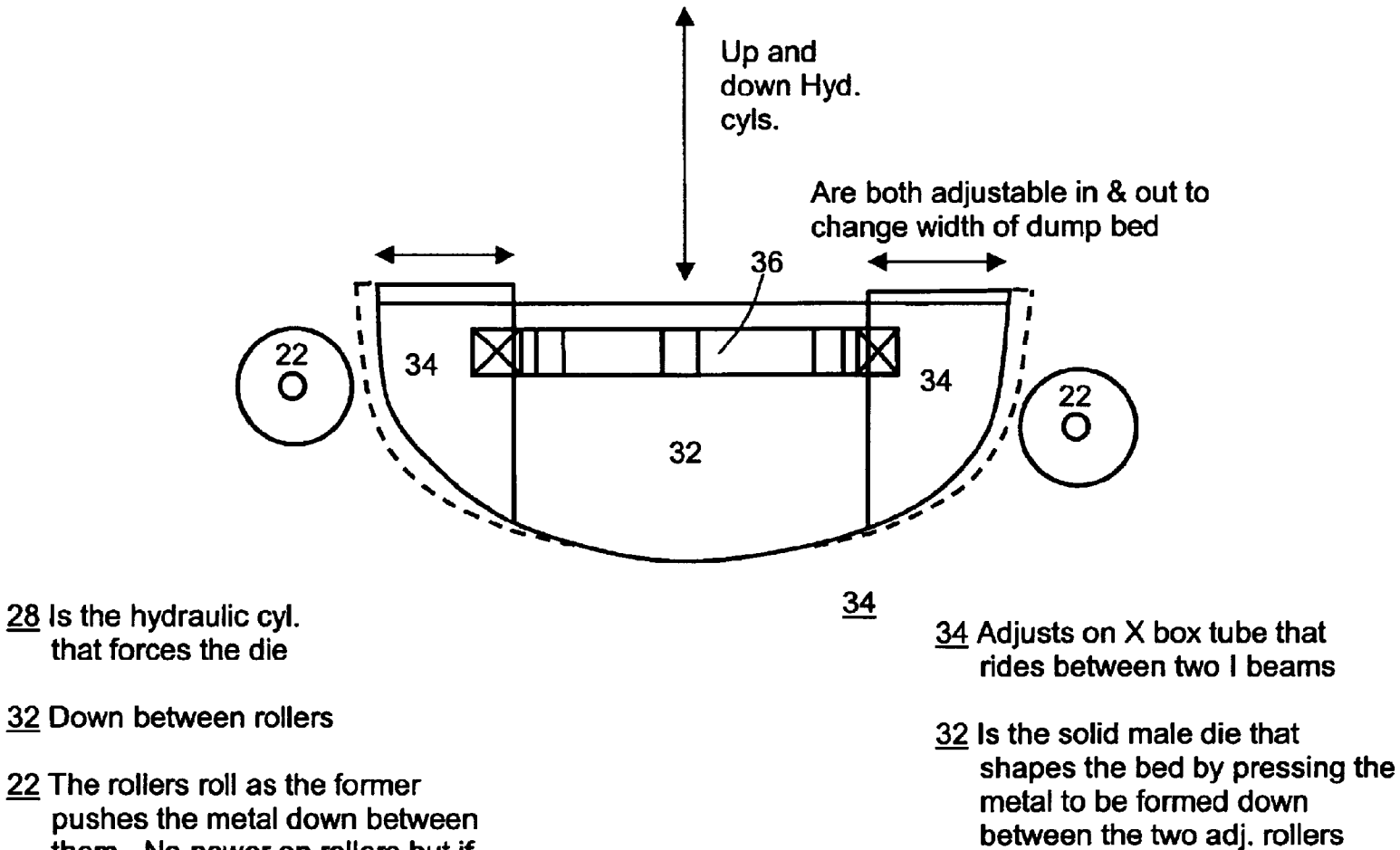
FIG. 3 is a front view of a portion of an exemplary bed forming apparatus.

Referring to FIGS. 1 and 2, an exemplary box forming apparatus 10 is illustrated. The dimensions illustrated throughout the drawings are of an exemplary nature and are not to be construed as limiting the scope of the disclosure. FIG 1 illustrates a front view of the box forming apparatus 10 prior to forming and FIG. 2 illustrates a front view of the box forming apparatus after forming. The box forming apparatus 10 includes a support structure 12 having a base 14 supporting sides 16 and a header 18 mounted on the sides 16. Located within the support structure 12 are forming elements 20. The forming elements 20 include two rollers 22 mounted on the base 14 in opposing fashion. The rollers 22 include adjustable mounts 24 and adjustable hydraulic presses 26. There can be other varieties of motive force for the adjustable rollers, such as electric, pneumatic, and the like. The forming elements 20 also include a forming press 28 mounted in the header 18. The forming press 28 can be a heavy-duty hydraulic press capable of deforming materials, such as the plate 30 shown in FIG 1. Coupled to the forming press 28 is a die 32. The die 32 includes adjustable die members 34 attached to an adjusting element 36. The die 32 is a solid male die that shapes the bed of the dump box. As would be appreciated by one having ordinary skill in the art and as can be seen in FIGS. 1–3, a male die is defined by a convex surface facing the base 14. The adjustable die members 34 are capable of adjustment to enlarge or reduce the size of the die 32 depending on the desired size of dump box.

FIG. 3 illustrates a front view of the forming die 32 located between the rollers 22. The forming die 32 is adjustable. FIG. 3 illustrates the adjustability of the forming die 32 employing the adjusting element 36 and adjustable die members 34.

Figure 4:
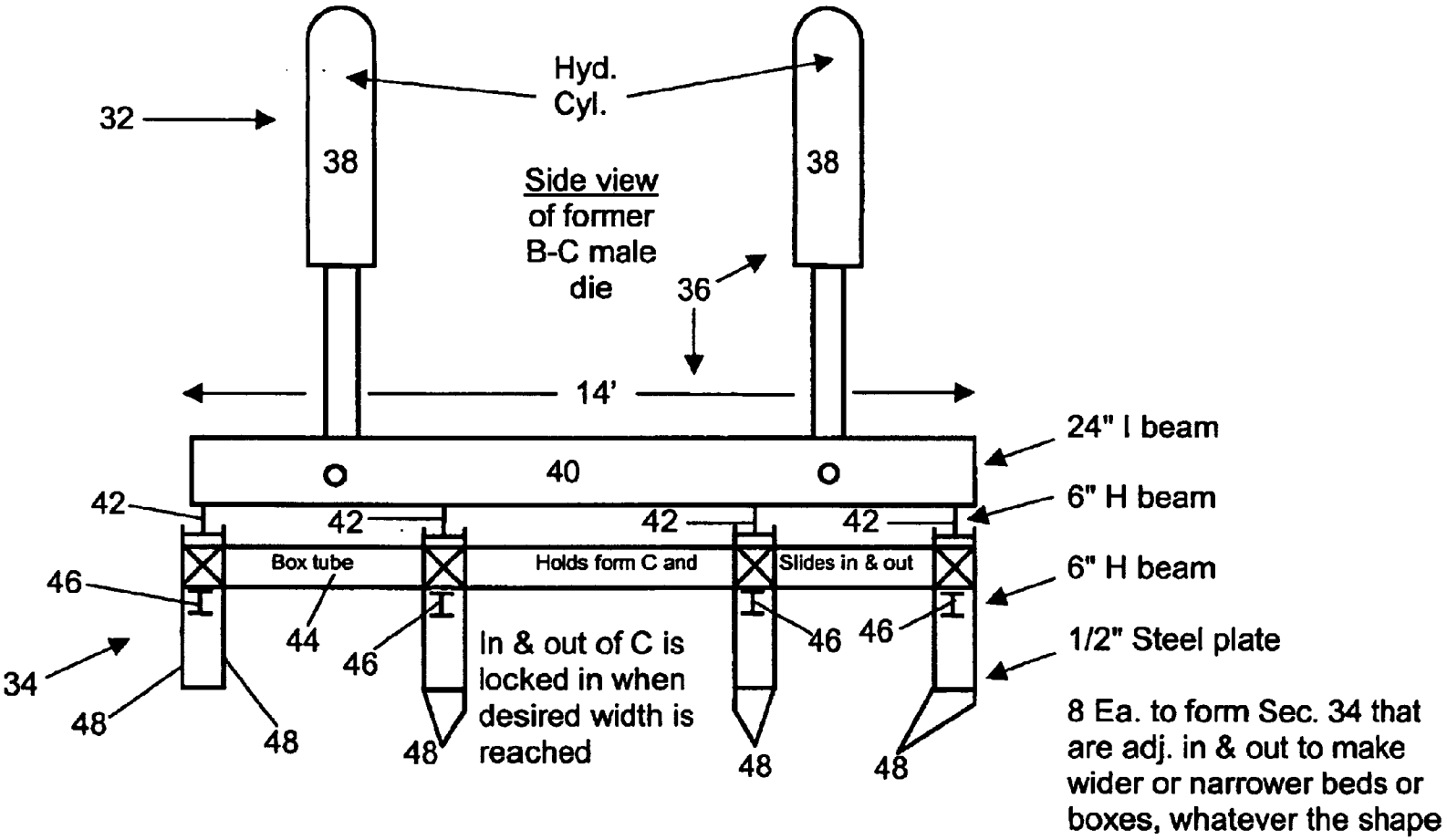
FIG. 4 is a side view of a portion of an exemplary bed forming apparatus.

FIG. 4 illustrates a side view of part of the die 32. The die 32 includes the adjustable element 36 (shown in part) that includes hydraulic cylinders 38 coupled to an I-beam 40. The hydraulic cylinders 38 provide the motive force to adjust the adjustable element 36. The I-beam 40 supports multiple H-beams 42 that support the adjustable die members 34. The adjustable die members 34 comprise box tube 44 coupled to H-beams 46 encased between plate members 48. The entire die 34 is adjustable with respect to the centerline "C" shown in FIG. 1.

Figure 5:
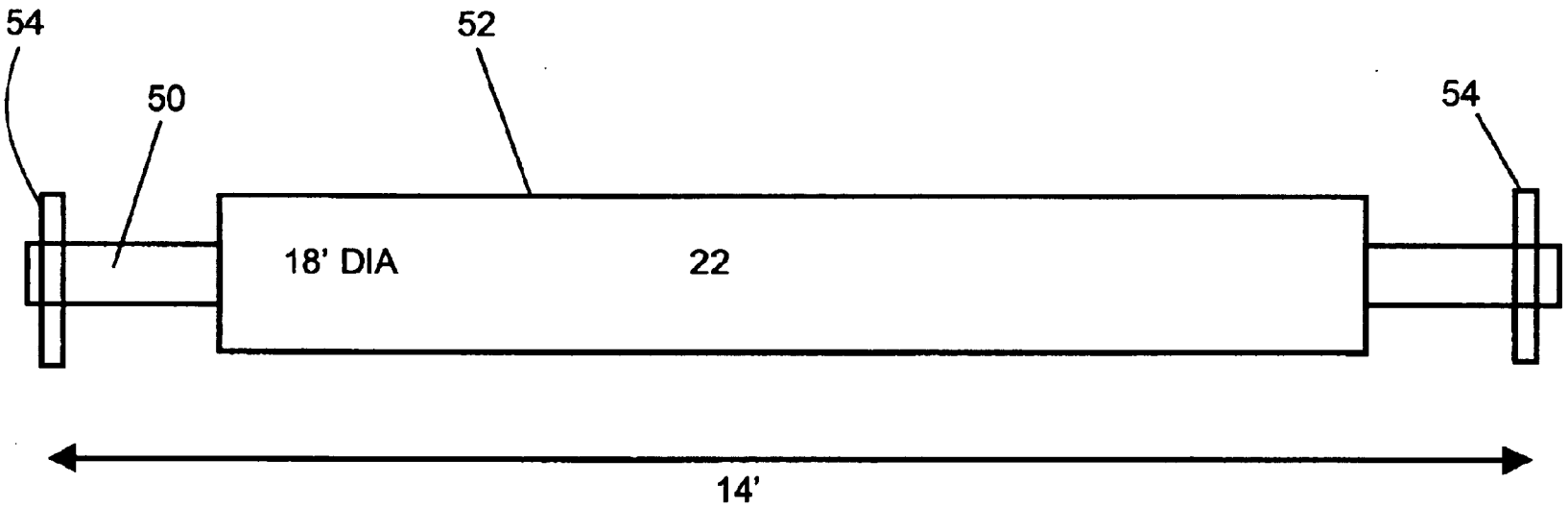
FIG. 5 is a top view of an exemplary roller.

FIG. 5 illustrates a top view of the adjustable roller 22. The adjustable roller 22 includes an axis 50 with a body 52 disposed on the axis 50. Mounts 54 are coupled to the axis at opposed ends of the body 52. The figures of this disclosure depict dimensions that represent a preferred embodiment. It is contemplated that other dimensions can be used.

The box forming apparatus 10 can be used to form dump boxes. A sheet of material 30 is positioned on top of the rollers 22 and below the forming press 28. The rollers are positioned such that, a determined size and shape box will be formed by the forming apparatus 10. The die 32 on the end proximate to the sheet of material 30 is also adjusted and set into a form to ensure the determined size and shape of the box. The forming press 28 is actuated and presses against the sheet of material 30. The forming press 28 advances toward the base 14 and forms the sheet of material 30 into a "U" shaped cross section. The formed material is then coupled to frame members 54 and an end member (not shown) is coupled one of the open ends of the "U" shaped formed material. The sheet of material 30 now forms the bed and two of the sides of the dump box. An end piece (not shown) that includes a dump gate can be attached to the opposite end of the "U" shaped form.

The box forming apparatus 10 simplifies the dump box construction process by using less parts, fewer steps and less manpower. The apparatus also produces a more uniform and consistent dump box.

What is claimed is:

1. An apparatus for forming dump beds comprising:

a support structure having a base configured to support at least one side;

a first side of said support structure coupled to said base;

a second side of said support structure coupled to said base;

a header mounted to said first side of said support structure and said second side of said support structure, said header disposed over said base and configured to support a forming press;

a first roller coupled to said base, said first roller including a first adjustable mount and a first press operatively coupled to said first adjustable mount;

a second roller coupled to said base opposite said first roller, said second roller including a second adjustable mount and a second press operatively coupled to said second adjustable mount; and a forming press mounted in said header, said forming press including at least one die coupled to said forming press, said forming press being configured to press a material between said first roller and said second roller to form a portion of a dump bed, wherein said at least one die includes at least one adjustable die member having a center and operatively coupled to at least one adjusting element, said at least one die is configured to form a male die and to alter the size and shape of the dump bed portion, said at least one adjusting element is configured to adjust said at least one adjustable die member with respect to said center of said at least one die.

2. The apparatus of claim 1 wherein said die includes an adjustable die member coupled to an adjusting element, said die being adjustable to form a plurality of dump bed sizes and shapes.

3. The apparatus of claim 1 wherein said first press and said second press have at least one motive force selected from the group consisting of an electric motor, pneumatic pressure and hydraulic pressure.

4. The apparatus of claim 1 wherein said forming press includes a heavy duty hydraulic press configured to deform plate material.

5. The apparatus of claim 1 wherein said dump bed portion is initially a plate material.

6. The apparatus of claim 1, wherein said at least one adjustable member is formed from I-beam elements coupled to hydraulic cylinders.

7. The apparatus of claim 1, wherein said male die is defined by a convex surface facing said base.

* * * * *